US008845832B2

(12) United States Patent
Riffee, Jr.

(10) Patent No.: US 8,845,832 B2
(45) Date of Patent: Sep. 30, 2014

(54) PROCESS FOR MANUFACTURE OF FASTENERS FROM A TITANIUM ALLOY

(75) Inventor: Buford R. Riffee, Jr., New Port Richey, FL (US)

(73) Assignee: Dynamet Holdings, Inc., Wilmington, DE (US)

( * ) Notice: Subject to any disclaimer, the term of this patent is extended or adjusted under 35 U.S.C. 154(b) by 1461 days.

(21) Appl. No.: 11/847,401

(22) Filed: Aug. 30, 2007

(65) Prior Publication Data

US 2009/0056841 A1 Mar. 5, 2009

Related U.S. Application Data

(63) Continuation-in-part of application No. 10/910,971, filed on Aug. 4, 2004, now abandoned.

(60) Provisional application No. 60/492,526, filed on Aug. 5, 2003.

(51) Int. Cl.
*C22F 1/18* (2006.01)

(52) U.S. Cl.
USPC ..... 148/671

(58) Field of Classification Search
CPC ..... C22F 1/183
USPC ..... 148/671
See application file for complete search history.

(56) References Cited

U.S. PATENT DOCUMENTS

| | | | | |
|---|---|---|---|---|
| 5,108,517 | A | 4/1992 | Kimura et al. | |
| 5,118,363 | A * | 6/1992 | Chakrabarti et al. | 148/671 |
| 6,454,882 | B1 * | 9/2002 | Martin | 148/421 |

* cited by examiner

*Primary Examiner* — Jessee Roe
(74) *Attorney, Agent, or Firm* — Dann, Dorfman, Herrell and Skillman, P.C.

(57) ABSTRACT

A process for making parts from titanium or a titanium alloy is disclosed. The process includes the step of preparing an intermediate form of titanium or a titanium alloy. The intermediate form is then solution heat treated under conditions of temperature and time that are selected to produce a desired level of strength when the titanium or titanium alloy part is subsequently age hardened. The solution treated intermediate form is then thermomechanically formed into a desired part or a preform for a desired part. The as-formed part or preform is then age-hardened under conditions of temperature and time that are selected to produce the desired level of strength in the finished part. The age-hardening step is performed without solution heat treating the as-formed part or preform again.

15 Claims, No Drawings

PROCESS FOR MANUFACTURE OF FASTENERS FROM A TITANIUM ALLOY

This application is a continuation-in-part of U.S. Nonprovisional application Ser. No. 10/910,971, filed on Aug. 4, 2004 which claims the benefit of priority of U.S. Provisional Application No. 60/492,526, filed on Aug. 5, 2003.

FIELD OF THE INVENTION

This invention relates to processes for making fasteners and other parts from titanium or a titanium alloy, and in particular to a process in which a titanium or titanium alloy part is solution heat treated before being thermomechanically formed.

BACKGROUND OF THE INVENTION

The titanium alloy Ti-6Al-4V has been used to make high strength fasteners, such as bolts and screws. The alloy is supplied in bar, rod, or wire form depending on the type and size of fastener to be made. Hitherto, the bar, rod, or wire has been supplied to the consumer in the annealed condition. The consumer forms the fasteners by such techniques as forging, heading, or extrusion, or a combination of those techniques. The fastener blanks are usually formed at an elevated temperature starting from about 1200° F. (649° C.), but usually not below about 800° F. (427° C.). The fastener blanks are then cleaned by immersion in a molten salt bath, which is followed with acid etching.

The fastener blanks are next heat treated to achieve a desired strength level. The known heat treatment is a two-stage treatment. In the first stage, the parts are solution treated, typically in an inert atmosphere, at about 1650 to 1775° F. (899 to 968° C.) for about 1 hour and then water quenched. In the second stage of the heat treatment, the parts are precipitation hardened by an aging treatment at about 800 to 1050° F. (427 to 566° C.) for 2 to 8 hours and then cooled in an inert gas or in a vacuum. Hitherto, the aging step has been performed directly after the solution-treating step.

The solution treatment is the most problematic step in the heat treatment cycle because during solution treatment contamination of the fasteners must be prevented. Titanium and its alloys are very reactive, especially at elevated temperatures such as those typically used for solution treatment. Any foreign material which comes into contact with the titanium or titanium alloy during solution heat treatment will result in contamination of the material. Common sources of foreign material in the solution treating process are contaminants in the furnace atmosphere or residual processing materials such as lubricants on the surfaces of the titanium blanks. In order to avoid the problems associated with the presence of such contaminants, special furnace atmospheres must be maintained and the fasteners must be thoroughly cleaned before they are placed in the heat treating furnace. Cleaning of the fasteners presents another problem because it involves the use of aggressive chemicals which pose environmental hazards and disposal concerns. Additionally, the cleaning operation can change the chemistry of the fasteners, such as by adding hydrogen, and can alter the dimensions of the fastener by dissolving metal from the blank. These problems make the cleaning step unreliable, time consuming, and costly.

The known solution treating operations are also troublesome because the process often results in the final parts being unacceptable. In some cases the parts become contaminated with impurities because of less than desirable furnace atmospheres or residual lubricants on the parts. In other cases the parts have poor mechanical properties because of inadequate quenching. Moreover, parts can become distorted or they may stick together during solution treatment, or they may become bent or develop flat spots. It is also a fact that solution heat treating equipment is expensive and costly to operate for parts manufacturers. Elimination of the need to solution treat the headed fastener blanks, along with the associated relaxation of cleaning requirements, would permit significant improvements in the efficiency of the manufacturing process and greater uniformity of product quality.

Fasteners are also manufactured by direct machining of solution treated titanium alloy bar. The machined fasteners are then age hardened. However, that process does not involve a forging operation. Therefore, it is not susceptible to the problems discussed above.

Beta titanium alloys, such as Ti 3-8-6-4-4 and others, are supplied in the solution treated condition for forming into fasteners. The fasteners are then aged to achieve the desired properties. However, there are significant metallurgical differences between the beta alloys and the other known titanium alloys such as alpha, near-alpha, an alpha-beta alloys.

SUMMARY OF THE INVENTION

In accordance with the present invention a process of making parts from titanium alloy wire, rod, or bar is provided. Here and throughout the remainder of this specification the term titanium or titanium alloy means alpha-beta titanium alloys. The process includes the step of preparing an intermediate form of titanium. The intermediate form is given a solution heat treatment under conditions of temperature and time that are selected to produce a desired level of strength when the titanium alloy is subsequently age hardened. After the solution treatment, but before the material is age hardened, it is mechanically worked at an elevated starting temperature. The mechanical working step is conducted from the starting temperature to a finishing temperature to provide a desired part or a preform for a desired part. Subsequent to the mechanical working step, but without another solution heat treatment, the as-formed part or part preform is age hardened under conditions of temperature and time that are selected to produce the desired level of strength in the part or part preform.

DETAILED DESCRIPTION

In a preferred embodiment of the process according to the present invention, an intermediate form of a titanium alloy, preferably Ti-6Al-4V, is prepared by any known method. Preferred intermediate forms include wire, rod, and bar. The Ti-6Al-4V alloy is a known titanium alloy that contains about 6 weight percent (%) aluminum, about 4% vanadium, and the balance is titanium and usual impurities. The impurities present in the alloy are restricted such that the alloy contains not more than about 0.10% carbon, not more than about 0.05% nitrogen, not more than about 0.0125% hydrogen, and not more than about 0.20% oxygen. In the preferred titanium alloy used in this process, the oxygen is preferably limited to about 0.14-0.17%. The method by which the intermediate form is made is not critical and any of the known methods for making titanium alloy wire, rod, or bar may be used.

The intermediate form of the titanium alloy is then solution treated at about 1650-1775° F. (899-968° C.) for a time of at least about 1 minute up to about 2 hours, and then water quenched. Preferably, the intermediate form is heated at the solution temperature for about 1 hour. Prior to forming a desired product from the intermediate form, the intermediate form may be coated with a lubricant. The preferred lubricant is a dry film lubricant, which consists of graphite and molybdenum disulfide. Other lubricants that are known to those skilled in the art for similar purposes may also be suitable.

The lubricated wire, rod, or bar is then subjected to thermomechanical working to form the desired part. The preferred forming operation is forging, and heading is particularly preferred for making small parts from wire or rod. For some applications extruding techniques can be used in connection with the preparation of parts by this process. After the solution treatment and prior to forming, the intermediate form is cut to a starting size, heated to an elevated starting temperature, and then mechanically worked to the desired size and shape. Preferably, the intermediate form is cut into pieces having a substantially uniform length. The elevated starting temperature for the thermomechanical forming is selected to be as close to the solution treating temperature as practicable. A lower forming temperature can be used for applications where adequate lubrication, extended die life, or dimensional control of the part or preform is important. Preferably, the parts are formed from a starting temperature of about 1600° F. (871° C.), but preferably not below about 1300° F. (704° C.) or 1200° F. (649° C.). Lower finishing temperatures may be used under appropriate circumstances. However, it is expected that the finishing temperature would, in any event, not be below about 800° F. (427° C.). The as-formed parts are rapidly cooled from the finishing temperature, preferably by water quenching.

The as-formed parts are then age hardened without a further solution heat treatment after the thermomechanical working step. The age-hardening heat treatment is preferably conducted in a vacuum heat treating furnace. The parts may also be aged in an inert atmosphere such as argon or helium. It is also expected that the parts can be aged in air. When the parts are aged in a vacuum furnace, it may be preferable to clean the parts to prevent their being contaminated in the heat treating furnace. Such cleaning is accomplished by first immersing the parts in a molten salt bath and then acid etching. Aging is conducted at a temperature of about 800 to 1050° F. (427 to 566° C.) for about 2 to 8 hours, followed by cooling in inert gas or in a vacuum.

The heat-treated parts are then ground or machined as necessary to final dimension and shape.

The Applicant has found that the hot working of the titanium intermediate form does not adversely affect the microstructural morphology of the material after the solution heat treatment. Therefore, the desired mechanical properties of the final or near-final part, particularly strength and toughness, can be fully developed without having to re-solution-treat the material after mechanical working and prior to age hardening. Thus, the elimination of the solution treatment after the mechanical hot working step provides a novel and unexpected advantage in the manufacturing of titanium fasteners and blanks for fasteners.

It will be recognized by those skilled in the art that changes or modifications may be made to the above-described embodiment without departing from the broad inventive concept of the invention. It should therefore be understood that this invention is not limited to the particular embodiment described herein, but is intended to include all changes and modifications that are within the scope and spirit of the invention as set forth in the following claims.

What is claimed is:

1. A process for making parts from a titanium alloy comprising the steps of:

preparing an intermediate form of an alpha-beta titanium alloy wherein said alpha-beta titanium alloy contains not more than 0.0125% hydrogen; then solution heat treating the intermediate form under conditions of temperature and time that are selected to produce a desired level of strength when the alpha-beta titanium alloy is subsequently age hardened; then reheating the intermediate form to an elevated starting temperature of about 1600° F. (871° C.);

mechanically working the reheated intermediate form from the elevated starting temperature to a lower finishing temperature not below about 800° F. (427° C.) to provide a desired part or a preform for a desired part; and then, without solution heat treating the as-formed part or preform again, age hardening the as-formed part or preform under conditions of temperature and time that are selected to produce the desired level of strength in said part or preform;

wherein after the solution heat treating step and before the mechanical working step the process comprises the step of cutting the intermediate form into pieces having a substantially uniform length.

2. The process as set forth in claim 1 wherein the alpha-beta titanium alloy comprises about 6% aluminum, about 4% vanadium, and the balance titanium and usual impurities.

3. The process as set forth in claim 1 wherein the step of preparing the intermediate form comprises the step of forming the alpha-beta titanium alloy into an elongated form selected from the group consisting of wire, rod, and bar.

4. The process as set forth in claim 1 comprising the step of rapidly cooling the part from the finishing temperature after said mechanical working step.

5. The process as set forth in claim 1 wherein the step of preparing the intermediate form of alpha-beta titanium alloy comprises the step of preparing the alpha-beta titanium alloy such that it contains not more than about 0.10% carbon, not more than about 0.05% nitrogen, and not more than about 0.20% oxygen.

6. The process as set forth in claim 5 wherein the step of preparing the alpha-beta titanium alloy comprises the step of controlling the melting of the titanium such that it contains not more than about 0.17% oxygen.

7. The process as set forth in claim 1, wherein the step of solution treating the intermediate form comprises the step of heating the intermediate form at a temperature of about 1650-1775° F. (899-968° C.) for at least about 1 minute up to about 2 hours, and then quenching the intermediate form.

8. The process as set forth in claim 1 wherein the age-hardening step comprises the steps of heating the as-formed part or preform to a temperature of at least about 800° F. (427° C.) to not greater than about 1050° F. (566° C.), holding the part or preform at said temperature for about 2 to 8 hours, and then cooling the part from said temperature.

9. The process as set forth in claim 1 wherein the mechanical working step is performed from the starting temperature to a finishing temperature not be about 1200° F. (649° C.).

10. The process as set forth in claim 1 wherein the mechanical working step is performed from the starting temperature to a finishing temperature not below about 1300° F. (704° C.).

11. A process for making parts from a titanium alloy comprising the steps of:

preparing an intermediate form of an alpha-beta titanium alloy; then solution heat treating the intermediate form at a temperature of about 1650-1775° F. (899-968° C.) for at least about 1 minute up to about 2 hours; then reheating the intermediate form to an elevated starting temperature of about 1600° F. (871° C.);

mechanically working the reheated intermediate form from the starting temperature to a lower finishing temperature to provide a desired part or a preform for a desired part; and then, without solution heat treating the as-formed part or preform again, age hardening the as-formed part or preform under conditions of temperature and time that are selected to produced a desired level of strength in the part or preform;

wherein after the solution heat treating step and before the mechanical working step the process comprises the step of cutting the intermediate form into pieces having a substantially uniform length.

12. The process as set forth in claim 11 wherein the mechanical working step is performed from the starting temperature to a finishing temperature not below about 800° F. (427° C.).

13. The process as set forth in claim 11 wherein the mechanical working step is performed from a starting temperature to a finishing temperature not below about 1200° F. (649° C.).

14. The process as set forth in claim 11 wherein the mechanical working step is performed from a starting temperature to a finishing temperature not below about 1300° F. (704° C.).

15. The process as set forth in claim 11 wherein the age-hardening step comprises the steps of heating the as-formed part or preform to a temperature of about 800-1050° F. (427-566° C.), holding the part or preform at said temperature for about 2 to 8 hours, and then cooling the part from said temperature.

* * * * *

UNITED STATES PATENT AND TRADEMARK OFFICE

CERTIFICATE OF CORRECTION

PATENT NO. : 8,845,832 B2
APPLICATION NO. : 11/847401
DATED : September 30, 2014
INVENTOR(S) : Riffee, Jr.

It is certified that error appears in the above-identified patent and that said Letters Patent is hereby corrected as shown below:

In the Claims:

Claim 6: Col. 4, line 3, after "titanium" insert -- alloy --.
Claim 9: Col. 4, line 3, "be" should read -- below --.
Claim 11: Col. 4-Col. 5, lines 16-17, "produced" should read -- produce --.

Signed and Sealed this
Twenty-seventh Day of January, 2015

Michelle K. Lee

Michelle K. Lee
*Deputy Director of the United States Patent and Trademark Office*